United States Patent [19]

Pesta

[11] Patent Number: 5,064,995

[45] Date of Patent: Nov. 12, 1991

[54] HEATING DEVICE FOR GENERATING VERY HIGH TEMPERATURE

[76] Inventor: Miroslav Pesta, 4 Sharon Place, Dukes Avenue, Windsor, Randburg, Transvaal, South Africa

[21] Appl. No.: 300,569

[22] Filed: Jan. 23, 1989

[30] Foreign Application Priority Data

Jan. 27, 1988 [ZA] South Africa ..... 88/0546

[51] Int. Cl.[5] ..... H05B 7/00; H05H 1/00

[52] U.S. Cl. ..... 219/383; 219/121.11; 338/88; 338/100; 373/18; 373/134

[58] Field of Search ..... 219/383, 121.36, 121.48, 219/121.52, 381, 374, 520, 538, 539, 552, 553, 121.11; 373/117, 132, 134, 18, 120, 3, 5; 338/88, 99, 100, 101, 104, 111, 204, 205, 223–225, 334; 252/502

[56] References Cited

U.S. PATENT DOCUMENTS

| | | | |
|---|---|---|---|
| 477,708 | 6/1892 | Sigsbee et al. | 338/100 |
| 497,793 | 5/1893 | Jenkins | 219/539 |
| 1,091,808 | 3/1914 | Calhane | 373/132 |
| 1,277,657 | 9/1918 | Smith | 219/306 |
| 1,448,388 | 3/1923 | Colby | 338/205 |
| 1,455,735 | 5/1923 | Rojas | 338/100 |
| 1,662,746 | 3/1928 | Howe | 219/553 |
| 1,687,677 | 10/1928 | Little | 338/204 |
| 3,934,117 | 1/1976 | Schladitz | 219/374 |
| 4,019,021 | 4/1977 | Schladitz | 219/381 |
| 4,163,204 | 7/1979 | Sado et al. | 338/100 |
| 4,292,505 | 9/1981 | Lee | 219/546 |
| 4,818,438 | 4/1989 | Wiley | 252/502 |

FOREIGN PATENT DOCUMENTS

| | | | |
|---|---|---|---|
| 1194776 | 11/1959 | France | 219/539 |
| 1016853 | 5/1983 | U.S.S.R. | 219/546 |

*Primary Examiner*—Geoffrey S. Evans
*Attorney, Agent, or Firm*—McGlew and Tuttle

[57] ABSTRACT

A heating device including a body comprised of two or more strata of electrically conductive refractory particles, a supporting element of a refractory material between adjacent strata and an arrangement for passing an electrical current through the body.

8 Claims, 5 Drawing Sheets

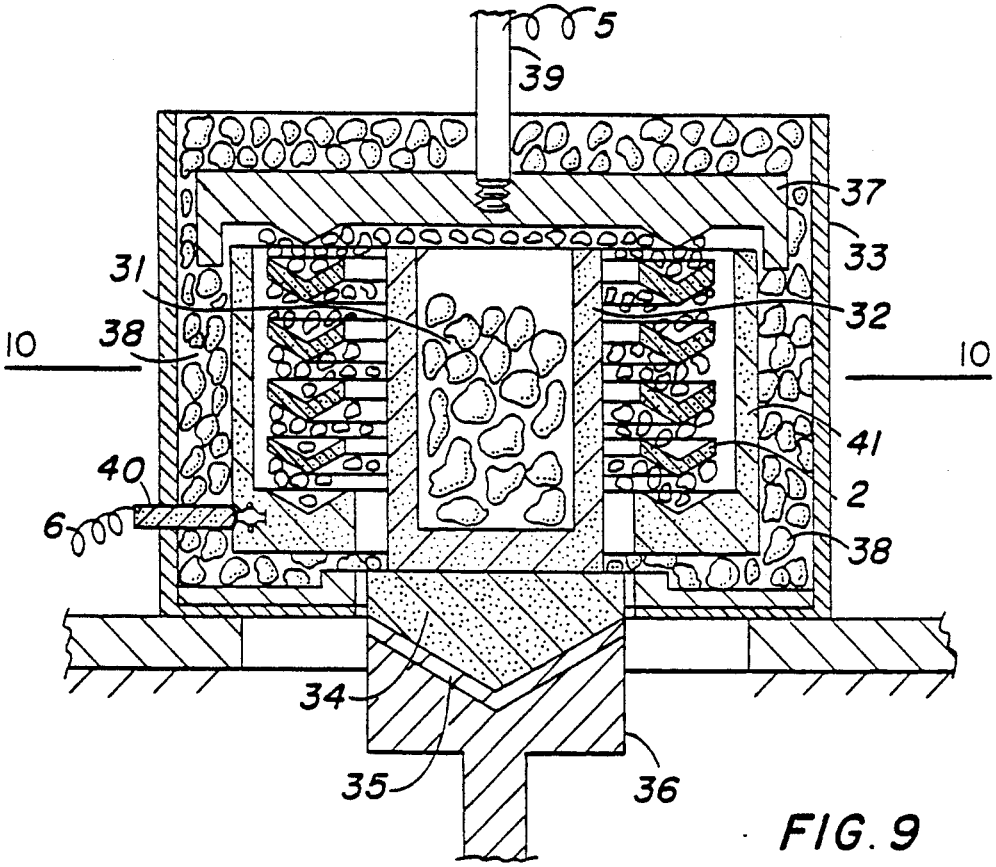
FIG. 9
FIG. 10
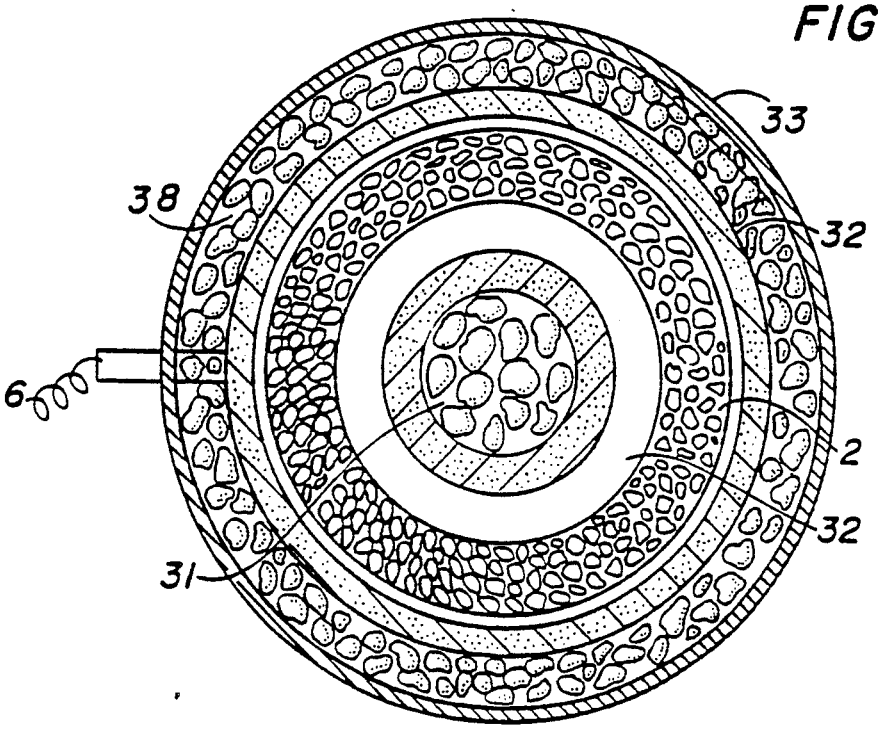

HEATING DEVICE FOR GENERATING VERY HIGH TEMPERATURE

BACKGROUND OF THE INVENTION

The present invention relates to heating devices for generating high temperatures.

It is known that high temperatures can be generated by passing an electrical current through a resistor. The maximum temperature thus attainable will be dependent on the material from which the heating element, i.e. the resistor, is made.

For very high temperatures, the heating elements are usually made of graphite.

Because graphite has a low electrical resistivity and in order to ensure that the resistance of the heating element is sufficient for the heat to be generated, the resistance of the heating element can be increased by either increasing its length or decreasing its cross-sectional area or both.

However, the mechanical strength and lifetime of the heating element can be decreased significantly if the chosen cross-sectional area is too small.

Therefore, the practical dimensions of the graphite heating element are selected in such a way that the element has sufficient electrical resistance and, at the same time, has an adequate mechanical strength.

In order to increase its length, and consequently its resistance, the graphite heating element can be in the form of a spiral.

High temperatures can also be generated by passing electrical current through a column consisting of lumps of coke. The resistance of the coke column is inversely proportional to the number and the area of contact points between the particles of coke as well as on the type of coke that is used.

The resistance of the coke column is significantly higher in comparison with, say, a bar of graphite of similar dimensions because the area of contact between the coke particles is small. The coke column has to be mechanically supported. This can be achieved by placing the coke column into a cylindrical vessel comprising of a refractory material such as alumina, magnesia etc. However, the maximum permissible temperature for the above-mentioned refractories is less than 2000 Celsius.

Theoretically, temperatures of the order of 4500 Celsius can be attained if graphite is used as the supporting vessel, instead of the vessel made of the above mentioned refractories. However, because graphite is a good conductor of electricity the electrical current will flow through the graphite vessel instead of through the coke, thus preventing attainment of the required temperature.

It is an object of the invention to provide a heating device which overcomes this difficulty.

SUMMARY OF THE INVENTION

According to the invention there is provided a heating device which includes a body comprised of two or more strata of electrically conductive refractory particles, a supporting element of a refractory material between adjacent strata and means to pass an electrical current through the body.

The body may be disposed in use in a furnace or high temperature device in a vertical, horizontal or inclined position.

In a preferred form of the invention the body has a plurality of supporting elements.

The supporting elements may have any suitable geometry, and may for example be triangular, square, rectangular, polygonal or circular.

In one preferred form of the invention the supporting elements are in the form of dishes or slabs with or without a central orifice.

Any suitable refractory material or materials may be used for the particles and supporting elements, for example carbides, nitrides or borides. However, in a preferred form of the invention, coke particles form the strata and the supporting elements are graphite. Coke is used because it is relatively cheap and graphite because of its ability to withstand high temperatures.

The heating device may additionally include means for generating an electrical arc or an extended plasma arc. The electrical or plasma arc is in this case generated between the coke column and graphite electrode. In another form of the invention a gas is passed through the heating device in order to generate a gas having a high temperature.

The invented device can be used as a smelter. In this case ore and reducing agents are fed directly onto the hot coke column where the ore is reduced to metal. The invented device can also be used for melting, vaporisation and distillation of metals.

BRIEF DESCRIPTION OF THE DRAWINGS

The accompanying drawings show various applications of the invention.

FIG. 9 is a vertical cross-sectional view of the heating device applicable for melting, FIG. 10 is a sectional view taken along the line E—E of FIG. 9.

DETAILED DESCRIPTION OF THE INVENTION

Various applications of the invented heating device are shown in FIGS. 1 to 10.

Figure 1:
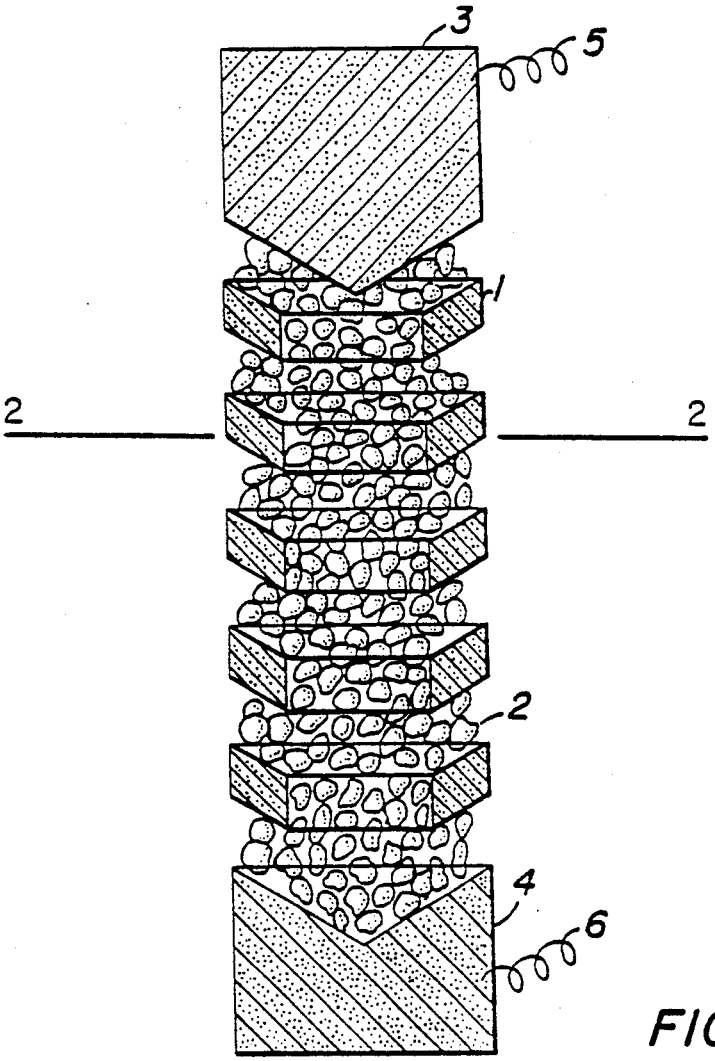
FIG. 1 is a vertical cross-sectional view of the heating device according to the invention applied as a heating element.
Figure 2:
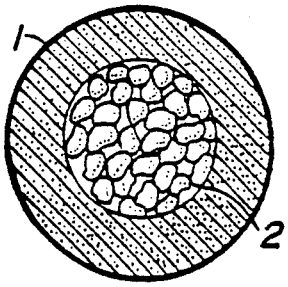
FIG. 2 is a sectional view taken along the line A—A of FIG. 1.

FIGS. 1 and 2 show a single heating element. The heating element consists of several annular graphite dishes 1 filled with coke 2 and which are placed one on the top of the other. An electrical source is connected to the heating element by graphite electrodes 3 and 4 via terminals 5 and 6. It will be noticed that, because of the hollow construction of the dishes 1, a central continuous column of contacting coke particles is established. However, since the dishes 1 are equidistantly spaced from each other, short circuiting of electrical current through the dishes is avoided.

The resistance of the heating element is controlled by the number of dishes in the column and by the cross-sectional area of the column.

The graphite dishes can be made of low-cost graphite because the mechanical strength of the dishes is not important.

The lifetime of the invented element is practically unlimited. The coke particles which are consumed during heating are continuously replaced by the neighboring particles of coke in the column.

At the stage when a large proportion of coke particles is consumed, the dishes are simply recharged with new coke.

Figure 3:
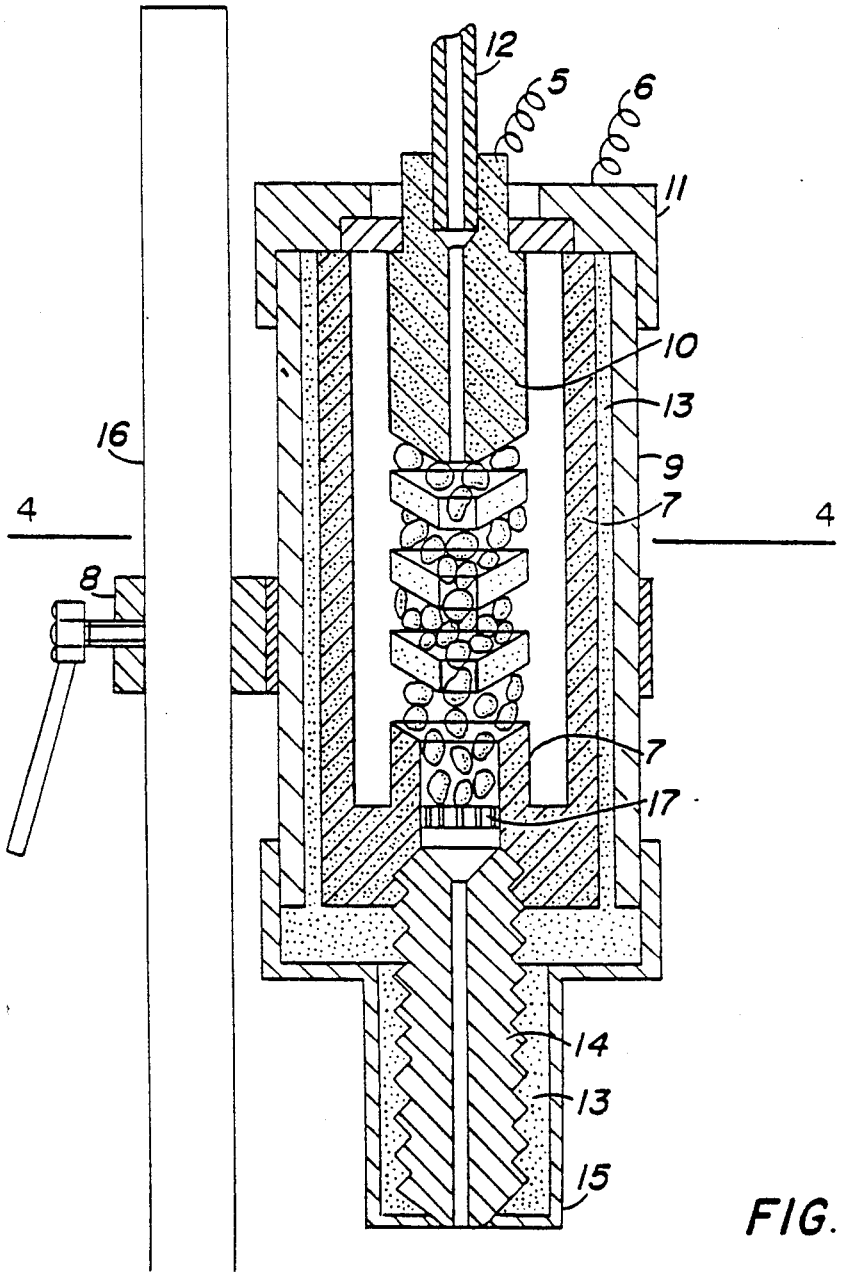
FIG. 3 is a vertical cross-sectional view of the heating device applied in a plasma generator.
Figure 4:
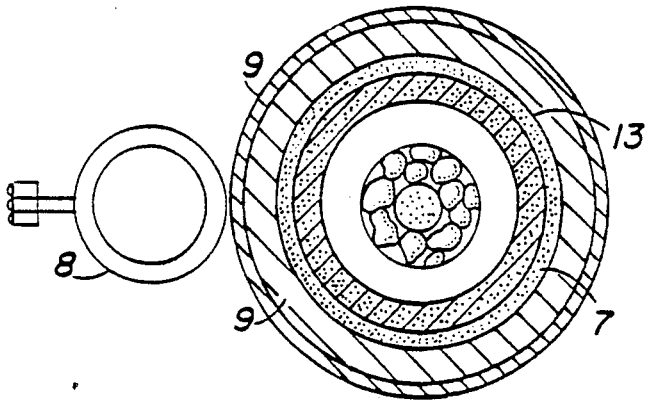
FIG. 4 is a sectional view taken along the line B—B of FIG. 3.

The application of the invention as a plasma torch is shown in FIGS. 3 and 4.

The heating element shown in FIGS. 1 and 2 is placed in a graphite crucible 7.

The graphite crucible 7 is immersed in fine refractory powder 13 which itself is contained in a metallic cylinder 9.

An electrical source is connected to the heating element by means of hollow graphite electrode 10 and by a metallic cup 11 via terminals 5 and 6. The metallic cup 11 is in electrical contact with the graphite crucible 7 and with the metallic cylinder 9.

The gas to be heated passes through metallic pipe 12, through the electrically heated coke column and finally through a perforated bottom 17 of the crucible 7 where it is directed by a nozzle 14 onto the object to be heated.

The nozzle 14 is covered by refractory powder 13 contained in a metallic case 15. The refractory 13 which is in contact with the nozzle 14 will melt. The nozzle 14 has an external thread, down which the molten refractory will flow under gravity to the tip of nozzle 14 the purpose of which is to protect it against oxidation.

The nozzle and the metallic case 15 are consumable parts of the torch. The plasma torch is attached to a stand 16 by a holder 8.

The plasma torch shown in FIGS. 3 and 4 is suitable for melting, cutting, welding or a heat treatment of various materials especially of such which are not electrically conductive and consequently conventional methods based on electrical or plasma arc cannot be applied.

In the case of electrically conductive materials, the temperature of plasma gas can be further increased by establishing an electrical arc between the nozzle 14 and the electrically conductive object. In this case, the electrical power source is connected instead to the terminal 6 and to the electrically conductive object.

In the case where plasma gas is used to increase temperature of a metallurgical process, the plasma torch being described can be used but without the nozzle 14.

The invented plasma torch is less costly than conventional types of plasma torches and is easier to operate.

Figure 5:
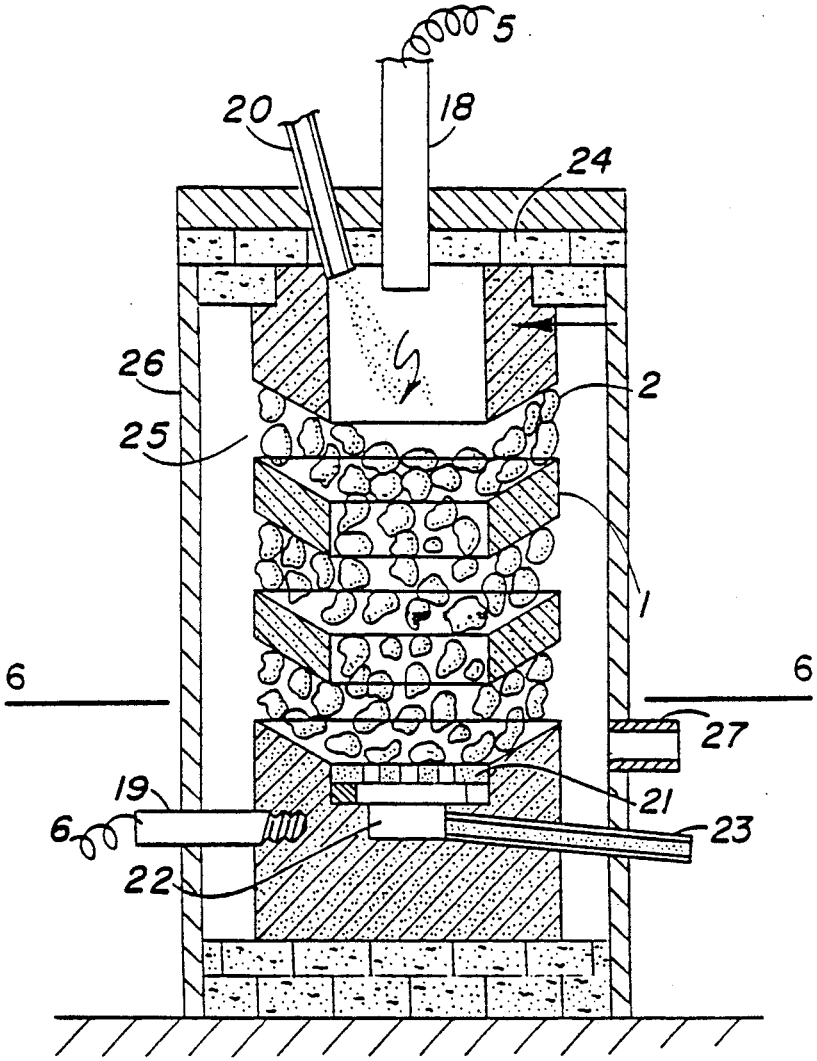
FIG. 5 is a vertical cross-sectional view of the heating device applied as a smelter.
Figure 6:
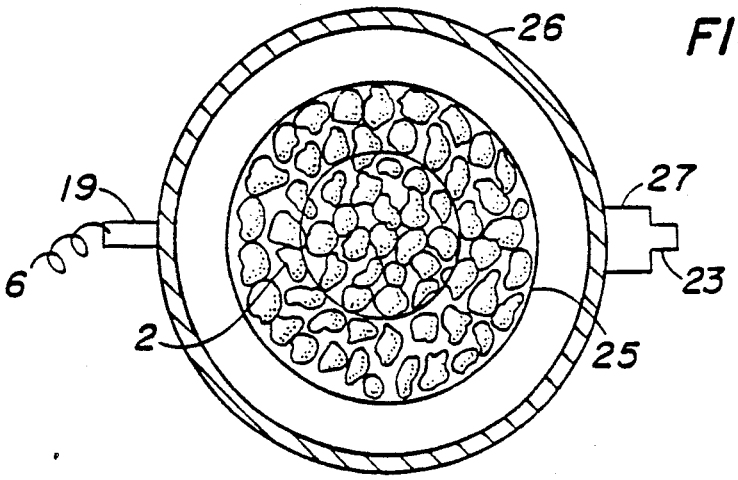
FIG. 6 is a sectional view taken along the line C—C of FIG. 5.

The application of the invention for the smelting of ore is shown in FIGS. 5 and 6.

A mixture containing ore and reducing agent is fed through a pipe 20 onto a hot coke column consisting of graphite hollow dishes 1 filled with coke 2.

The feed is heated by an electrical arc struck between a graphite electrode 18 and the coke 2 as well as by heat produced by the electrical current passing through the coke column.

The melt descends through the coke column then through the grate 21 and is collected in a small chamber 22 underneath the grate 21. The melt is continuously removed from the smelter via pipe 23.

The electrical power is supplied to the column by means of electrodes 18 and 19 which are connected to terminals 5 and 6. The gas produced by the reaction permeates out of the coke column into a gas chamber 25. The gas chamber 25 is enclosed by a roof 24 and a mantle 26.

The gas from the gas chamber 25 is removed via a pipe 27.

The main features of the smelter are:

The smelter can operate at extremely high temperatures up to the melting point of graphite; i.e. 4500 Celsius. This can be advantageous in the reduction of difficult to reduce oxides such as zirconium dioxide.

The lifetime of the furnace is long because the melt does not come into contact with the external lining of the furnace.

The rate of consumption of coke contained in the coke column is low provided that a reducing agent contained in the feed is in the form of fine powder well mixed with the ore.

The smelter dimensions are one order of magnitude smaller than that of an electrical submerged-arc furnace having the same metal output. The reduction in an electrical submerged-arc furnace takes place in a small region under the electrode while in the invented smelter the reaction takes place in the whole region embraced by the graphite dishes.

The smelter is suitable for continuous processes and for the processes carried at low pressure due to the high gas permeability of the coke column.

Volatiles contained in the reducing agent are consumed in the reduction reactions consequently reducing agents containing a high proportion of volatiles can be used for the reduction.

The gas evolved in the reduction reactions is filtered while passing out of the hot coke of the coke column.

The furnace is particularly suitable for the smelting of fine ores.

The electrical resistance of the smelter can be controlled by height and cross-sectional area of the coke column.

The furnace applicable for melting of metals is shown in FIGS. 9 and 10.

Figure 7:
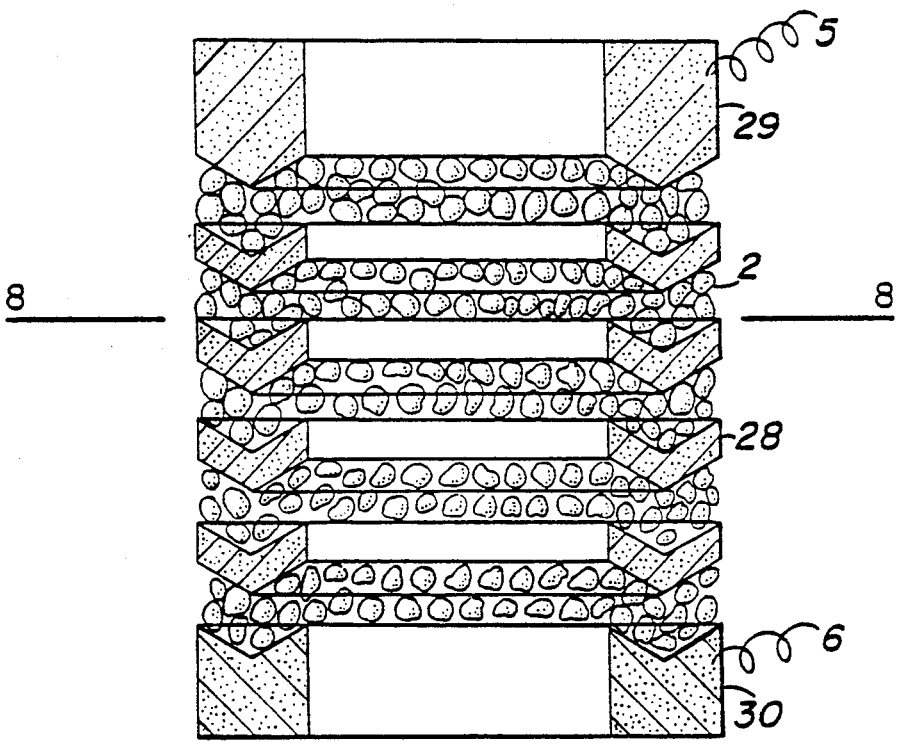
FIG. 7 is a vertical sectional view through a tubular heating element incorporating in the device of FIGS. 9 and 10.
Figure 8:
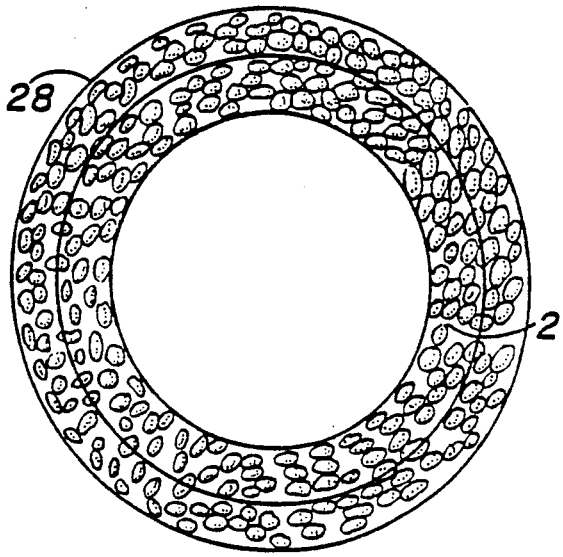
FIG. 8 is a sectional view taken along the line D—D of FIG. 7.

The furnace is equipped with the tubular heating element shown in FIGS. 7 and 8.

The tubular heating element consists of rings 28 of V-profile filled with coke 2. The rings 28 filled with coke 2 are placed one on top of the other.

The heat in the element is generated by passing electrical current through the element via electrodes 29 and 30 connected to terminals 5 and 6. The heat is mainly evolved at contact points between the coke particles and between the coke particles and rings.

An embedment of the tubular heating element in a furnace for melting of metals is shown in FIGS. 9 and 10.

The charge 31 placed in the crucible 32 rests on a graphite base 34. The graphite base 34 is placed on a base 35 made of an insulating material. The crucible 32 resting on the base 34 and 35 is brought into the furnace by means of a piston 36. The crucible 32 is enclosed in a chamber consisting of a roof 37 and a graphite cylinder 41.

The graphite crucible 32 is heated by radiation emanating from the tubular heating element already described.

The graphite cylinder 41 which acts as a reflector of radiation is insulated by lumps of refractory 38 placed between cylinder 41 and the metallic case 33.

Electrical current is supplied via terminals 5 and 6.

Electrical current flows through the electrode 39, through the heating element, through the bottom of the graphite cylinder 41 to the graphite electrode 40.

The tubular heating element is applicable for various types of reactors, furnaces and distillation columns of a cylindrical geometry.

The present invention is not limited to the precise constructional details and many variations in detail are possible without departing from the spirit and scope of the invention as defined in the appended claims.

I claim:

1. A heating device including a body comprised of two or more strata of electrically conductive refractory particles, a graphite supporting element between adjacent strata and electrodes for passing an electric current through the body; and, means for generating an electrical arc or an extended plasma arc between an electrode and the body.

2. A heating device including: a self supporting vertical column having a plurality of vertically stacked open vessels made of refractory materials, electrically conductive refractory particles, the vessels being spaced from one another and resting on the refractory particles; and, means for passing an electrical current through the column.

3. A heating device according to claim 2, wherein each vessel includes a central orifice defined therein.

4. A heating device according to claim 2, wherein the refractory particles of the column are coke particles.

5. A heating device according to claim 2, wherein each of said plurality of vertically stacked open vessels is formed of graphite.

6. A heating device according to claim 2, further comprising means for generating an electrical arc or an extended plasma arc between an electrode and the column, said means for passing an electrical current through the column includes a pair of electrodes.

7. A heating device according to claim 2, further comprising means for passing a gas through and along the column in order to generate a gas of high temperature.

8. A heating device according to claim 2, further comprising means for feeding material which is to be melted, reduced, vaporized, distilled, refined or degassed onto one end of the column.

* * * * *